US008756958B2

(12) United States Patent
Zhao-Cheng

(10) Patent No.: US 8,756,958 B2
(45) Date of Patent: Jun. 24, 2014

(54) IMPULSE TYPE SHOCK WAVE FLASH DYEING MACHINE

(76) Inventor: Jiang Zhao-Cheng, Xindian (TW)

( * ) Notice: Subject to any disclaimer, the term of this patent is extended or adjusted under 35 U.S.C. 154(b) by 997 days.

(21) Appl. No.: 12/848,181

(22) Filed: Aug. 1, 2010

(65) Prior Publication Data

US 2012/0024017 A1 Feb. 2, 2012

(51) Int. Cl.
*D06B 3/28* (2006.01)

(52) U.S. Cl.
USPC ..... 68/177; 68/131; 68/178

(58) Field of Classification Search
CPC ..... D06B 3/24; D06B 3/26; D06B 3/28
USPC ..... 68/131, 177, 178
See application file for complete search history.

(56) References Cited

U.S. PATENT DOCUMENTS

| | | | | |
|---|---|---|---|---|
| 3,016,728 | A * | 1/1962 | Mann et al. | 68/177 |
| 3,501,931 | A * | 3/1970 | Barriquand | 68/177 |
| 3,511,068 | A * | 5/1970 | Fujii | 68/177 |
| 3,599,447 | A * | 8/1971 | Arashi | 68/177 |
| 3,780,544 | A * | 12/1973 | Turner et al. | 68/177 |
| 4,142,385 | A * | 3/1979 | Sandberg et al. | 68/178 |
| 4,318,286 | A * | 3/1982 | Sturkey | 68/178 |
| 5,014,525 | A * | 5/1991 | Bene | 68/20 |
| 5,299,339 | A * | 4/1994 | Georgantas | 8/152 |
| 5,765,761 | A * | 6/1998 | Law et al. | 239/690.1 |
| 5,775,136 | A | 7/1998 | Chao-Cheng | |
| 6,393,871 | B1 * | 5/2002 | Chiang | 68/5 D |

FOREIGN PATENT DOCUMENTS

CA 2288214 A1 4/1997

* cited by examiner

*Primary Examiner* — Michael Kornakov
*Assistant Examiner* — Marc Lorenzi
(74) *Attorney, Agent, or Firm* — Chun-Ming Shih

(57) ABSTRACT

An impulse type shock wave flash dyeing machine is disclosed. A row of joint nozzles can send out high-speed air flows to prompt fibrous fabric to spread out and move in the dyeing machine through the effect of impulse. Dyes or processing agents may be converted into fine mist and is carried by the high-speed air flows to blast the fibrous fabric (3). Therefore, the dyes or processing agents can enter the fibrous fabric (3) quickly and can diffuse or spread out in the fibrous fabric (3) swiftly through strong elastic and inelastic collisions as well as the effect of shock wave. Such collisions and effect can impart enough energy to the dyes or processing agents and convert non-activated molecules into activated molecules. In addition, the effect of corona discharge may be used to generate high-energy particles and hence the goals of clean and swift processes may be achieved.

4 Claims, 12 Drawing Sheets

IMPULSE TYPE SHOCK WAVE FLASH DYEING MACHINE

BACKGROUND OF THE INVENTION

1. Field of the Invention

The invention relates to an impulse type shock wave flash dyeing machine, which is abbreviated as a shock wave dyeing machine. The dyeing machine of the present invention is an improved version of the spray dyeing apparatus with breadth expansion and vibration-enhanced dyeing operation and is a machine that may be used to carry out the dyeing process and other processes and that is characterized with high efficiency, multiple functions, multiple applications and environmental friendliness.

2. Description of the Prior Art

To slow down the global warming and climate change, many processing technologies have been used in the processing of fibrous fabric. These technologies include shock wave technology, electrochemistry, low-temperature plasma technology, carbon dioxide supercritical fluid technology, biological enzyme technology, supersonic technology, radioactive energy technology, microwave technology, etc. These technologies are characterized with convenience, swiftness, effectiveness, a wide range of applications, environmental friendliness, being able to save dyes and energy and being able to be used with automated computer control devices. Therefore, these technologies have been developed swiftly in many places of the world. However, most dyeing machines of the prior art have only a single application and there has not been any dyeing machine that has multiple functions and multiple applications and that is environmental friendly on the market. In light of the above, the invention with the title of "Spray dyeing apparatus with breadth expansion and vibration-enhanced dyeing operation" has been patented in more than 20 countries: Taiwan (date of application: Feb. 25, 1997; application no.: 86,102,237), China (date of application: Apr. 29, 1997; application no.: ZL97 1 82145.3) the U.S. (date of application: Mar. 31, 1997; application Ser. No.: 828,884), Canada (date of application: Apr. 29, 1997; application no.: 2,288,214), EU (date of application: Apr. 29, 1997; application no.: 97917988.4), India (date of application: May 28, 1997; application no.: 1126/MAS/97), Japan (date of application: Apr. 29, 1997; application no.: 10546452), Korea (date of application: Oct. 28, 1999; application no.: 997009996), etc. To reach the goal of clean processes and to save energy and reduce carbon footprint, the inventor has put a lot of effort into the subject and has successfully come up with the dyeing machine of the present invention by employing new technologies and new approaches.

Because water has been used as the medium in the wet type process of textile products, the textile dyeing and finishing industry has been discharging a lot of contaminated water. The global textile market has been forced to provide green products under the pressure from global warming. Such trend is a tough challenge to the textile dyeing and finishing industry. To reach the goal of continuous development of the textile dyeing and finishing industry, the adoption of clean processing technologies has been regarded as the only solution.

In fact, global warming and climate change have become urgent issues. The textile dyeing and finishing industry should speed up in the adoption of new thinking and employ new processes, use new processing facilities and adopt new methods.

In the dyeing machine of the present invention, to make the machine that saves energy and water and that can carry out processes in a clean manner, fibrous fabric, dyes and processing agents are placed in a high-energy wave field to reach the goal of fast and efficient processes through the wave field. In addition, low-temperature plasma technology is used to reach the goals of waterless process, innovative approach and optimal effect.

As of now, most of the dyeing and finishing machines are wet type machines that can be used for only one purpose at a time. Therefore, they consume an excessive amount of water and energy and seriously pollute the environment. Also, their processing costs are too high and they seriously damage the eco system.

As of now, clean processes in which small amount and many types of fabric may be processed and that is multifunctional are the preferred choice of the textile dyeing and finishing industry. Therefore, green dyeing machines with these three advantages would be the main production facilities in the industry. Many problems and disadvantages still can not be solved in the dyeing machines of the prior art (including the spread-out type and non-spread-out type air flow dyeing machines and the traditional injection type dyeing machine). Such problems and disadvantages include the right portion of the fabric having a different color from that of the left portion, the inconsistency in color for the same patch of fabric, uneven application of the dyes, the fabric circulation wheel being unable to move in sync with the nozzles, the fabric not able to move fast enough, damages caused by friction and collision, the fibers of the fabric being broken by the excessive amount of force exerted by the nozzles, the clogging of the nozzles and the filtering units, the fabric unable to have a pleasant feel, the low efficiency in the bio enzyme process, processes being carried out too slowly, the machine not having enough functions and hence the processes being limited, excessive use of energy and water, etc. Therefore, the cost for the treatment of contaminated water skyrockets. Also, the fabric circulation wheel poses a danger to the users. In addition, finished fabric may not have a good feel. Poor design is the main reason for all of the aforesaid problems. An example would be the uneven heat transfer among the fabric and the dyes, processing fluids and air flow. For example, the inconsistency in color is caused by the more-than-one processing tanks and the uneven division or distribution of the dyes and air flow. It is difficult to equally divide the fluid or flow in a tube into two exactly equal parts (in the prior art, a single tube is divided into two tubes, two tubes are then divided into four tubes and four tubes are divided into eight tubes), resulting the inconsistency in color. To reach the goal of clean processes, the aforesaid problems must be solved simultaneously. In addition, a modification or re-dyeing may be needed when there is an unsatisfactory result and such modification or re-dyeing would be a waste of energy and water and increase the production cost.

There are four stages in the dyeing process:

1. Dye approaches the surfaces of fabric. In this stage, the dyeing process does not correlate with the quality of the dye and the condition that the dye is in. In this stage, the dye molecules dissolved in the solution or fluid or larger pieces or particles of the dye suspended in the fluid or solution move with the dyeing fluid. Also, the speed of the dye depends on the speed of the flow of the dye.
2. A stagnant layer exists between the fabric and the surface. As the dye reaches the stagnant layer, the dye may get closer to the surface via diffusion. In this stage, the speed of the dye depends on the flow of the dye and the diffusion speed of the dye. Dye in a dissolved condition diffuses much faster than dye in a suspension condition does. Therefore, the solubility of the dye determines the speed of the dye.

3. At a certain distance between the dye and the surface of the fabric, the dye would swiftly attach to the surface as the molecular attraction between the dye and surface becomes sufficiently large. In this stage, the speed of the dye is determined by the interaction between the dye and the fabric and the solubility, which plays a more important role. Therefore, the speed of the dye is greater if the interaction is greater or the solubility is higher.
4. After the dye attaches to the surface of the fabric, the difference in concentration level between the inside of the fabric and the outside of the fabric occurs. By the Fick's law, the dye would move from the surface to the interior of the fabric. Now, the speed of the dye is determined by the molecular structure and physical structure as well as the concentration level of the dye. The greater total area of non-crystalline areas is, the greater the speed of the dye moving toward the interior of the fabric is. The greater the pore size is, the greater the speed of the dye is. The greater the concentration level of the dye at the surface is, the greater the speed of the dye is. In this stage, the speed is determined by the levels of expansion and plasticization of the fibers and the concentration level of the dye at the surface.

From the above, we can see that the dyeing speed is determined by the levels of expansion and plasticization of the fabric. In fact, we do not need a large amount of the operating solution to dissolve the dye. If the dye dissolves in an excessive amount of the operating solution in the dyeing process, the operating solution may reduce the contact and interaction between the dye or processing fluid and the fabric. In addition, the majority of the input energy would be absorbed by the operating solution. After the operating solution absorbs the energy, the energy would be used for the revolution of the molecules of the operating solution, the vibration of the atoms of the operating solution and the interactions (between the molecules of the operating solution) that are not correlated to the dyeing process and other process.

To increase the level of solubility of the dye, a certain amount of polar radicals is usually added into the dye. The addition of polar radicals may increase the interaction between the dye and the fabric in few cases. However, it is difficult to process and purify the residual solution after the dyeing process.

Regarding dispersal dye, which has a level of solubility, because it does not have ion radicals, the dyeing process is quite difficult to carry out. A large amount of dispersion agent has to be used to make it suspending in the operating fluid and the state of such suspension is difficult to maintain. In addition, the residual solution is difficult to purify. Therefore, a good way would be to increase the solubility of the dispersal dye to facilitate the dyeing process (reducing the amount of the dispersion agent or not using the dispersion agent).

Regarding synthetic fiber, because it is difficult for such fiber to dissolve in water, it is difficult for the dye to diffuse inside the synthetic fiber. The dyeing process for such fiber usually requires a higher temperature. For example, the temperature has to be raised to 130 degree C. to carry out the dyeing process on the polyester fiber. Such temperature may be lowered if the levels of expansion and plasticization of such fiber are enhanced (the diffusion speed of the dye in such fiber would be increased).

With regard to natural fiber, it has a complicated structure and many cavities, which are filled with air. Therefore, it is difficult for the dye to enter the fibers and dyeing process takes a longer time. With regard to wool, a scale layer exists on the surface of wool and can hinder the entry of dyes. In the past, dyeing at the boiling point is used for the dyeing of wool and such dyeing takes a longer time. Therefore, such dyeing consumes more energy and wool fiber can be damaged. In addition, because reactive dye may react with water at high temperatures and in alkaline solution, the efficiency of dyeing is reduced. Also, after the dyeing process, both the residual solution of the dyeing and the unfixed dyes in the post-treatment are highly polluted solutions.

An important factor in dyeing is that the dyes must first dissolve in the operating solution to become single molecules because only such single molecules can swiftly attach to the fibers and enter into the interior of the fibers. If the physical mechanism generated by waves and high-energy particles of the present invention is used, the solubility of a dye with a lower solubility may be enhanced in an operating solution that has a high level of concentration and is in a small amount; therefore, dyes may be attach to the fiber swiftly, the levels of solubility and plasticization of the fiber may be enhanced and dyes may diffuse swiftly in the fiber. Hence, the overall dyeing speed is enhanced. If a dye having a stronger bonding force with the molecules of the fiber is chosen, the dyeing process may be carried out easily and such dye has a higher level of attachment.

To increase the dyeing speed, we can decrease the amount of water, select an appropriate dyeing machine, enhance the interaction between the dye and fabric, choose dyes suitable for the fabric and use dyeing assisting agent and dyeing medium; in addition, the molecular structure and physical structure of the fiber plays a crucial role. If the fiber undergoes a proper pre-treatment or a pre-treatment that can change the quality of the fiber or the fiber's quality is changed in the dyeing process, the dye may attach to the surface of the fiber more quickly and may diffuse inside the fiber more swiftly; in addition, less time is needed in the dyeing process and a lower temperature is needed. Therefore, the goals of high energy efficiency, carbon footprint reduction and clean processes may be achieved.

SUMMARY OF THE INVENTION

In the impulse type shock wave flash dyeing machine of the present invention, dyes, processing fluids, low-temperature plasma and other media may be spread out in high speed air flow via the acceleration effect of the joint nozzles. These dyes, processing fluids, low-temperature plasma and other media are present with fibrous fabric in a high-energy wave field. Therefore, each of them is imparted with a sufficient amount of activation energy. Whence, the goal of most economical process may be reached within the shortest period of time.

In use, the fast moving air, steam, dyes, processing agents and low-temperature plasma blast the fibrous fabric. As the fibrous fabric turns or descends, energy transfer may be carried out efficiently from the fast moving air, steam, dyes, processing agents and low-temperature plasma to the fibrous fabric. In addition, the dyes and processing agents are imparted with a high amount of kinetic energy and are in the form of fine mist or individual molecules as they flow in the air flow. The fine mist of dyes and processing agents violently collide with the direction-changing fibrous fabric in the manner of elastic collision (the collision between air or gas and the fibrous fabric) or inelastic collision (the collision between processing agents, dyes or plasma and the fibrous fabric). The inelastic collision results in highly efficient transfer of kinetic energy and hence the fibrous fabric would move faster. The inelastic collision also supplies sufficient amount of fluid to generate the effect of cavitation. In addition, a reflective motion plate can generate a high-speed wavy motion on the fibrous fabric. The air pressure of the upper portion of the fibrous fabric is greater than the air pressure of the lower portion of the fibrous fabric. The difference in air pressure prompts the fibrous fabric to move in a violent high-frequency wavy motion and to spread out as the fibrous fabric passes the reflective motion plate.

In a wet type process, if there is enough amount of fluid attached to the surfaces of the fibrous fabric and the air flow has enough amount of speed or kinetic energy, a large amount of cavities may be generated in the peripheral portions of the surfaces of the fibrous fabric and shock waves may be generated in the peripheral portions. In a dry type process, the air molecules contained in the fast-moving air flow may be ionized via corona discharge or glow discharge to become fast-moving low-temperature plasma. Therefore, such high-energy plasma may be used to process the fibrous fabric and the goal of waterless process, which is environmentally friendly, may be achieved.

In use, the swift closures and openings of the air pathway would occur. Such effect makes the fibrous fabric wiggling violently as it passes the fabric accumulator to make the operating solution, loose fibers and solid objects detach from it. In the mean time, the fibrous fabric is folded up. Also, after the operating solution, loose fibers and solid objects detach from it, they would flow to the outlet and then to the solution gathering tank. Then, the solution is filtered out to remove the operating solution, loose fibers and solid objects. Therefore, the solution is purified and may be used for the next cycle of operation. Dyes and processing agents, that have a high concentration level and have been dissolved into the liquid form, may be replenished via the pump-less content adding device. Therefore, the dyes and processing agents may be mixed well with the operating solution to enable the processes to be carried out with a small amount of operating solution. Therefore, as the fibrous fabric has contact with the dyes or processing fluids, the fabric may have a higher level of potential energy and kinetic energy and the dyes and processing agents may have a higher level of concentration gradient, temperature gradient and chemical affinity so that the dyes and processing agents may diffuse in the fabric swiftly. In addition, the effect of several pieces of fabric squeezing each other in the fabric accumulator is reduced to a minimal level and the tension of the fabric is reduced to a minimal level as it moves swiftly in the fabric guiding tube. In use, dyes and processing agents go through the circulation pump; the fluid cross flow distributor can convert the dyes and processing agents into fine mist and the spray coming out from each spraying nozzle has the same pressure, amount, temperature and speed.

After the air flow is compressed by the blower, it will be distributed by the air cross flow distributor into the distributing tubes. The expansion effect of the air cross flow distributor can covert the kinetic energy of the air flow into static pressure; therefore, as the air flow comes out from each air nozzle and joint nozzle, its speed increases and it will come out from each of these nozzles with the same pressure, amount, temperature and speed. Therefore, dyes and processing agents may be sprayed out evenly on the fabric. In addition, backflow air may flow back to the air backflow unit and hence disturbance may be removed and the goal of stable cyclic air flow may be achieved.

In particular, the dyeing machine of the present invention further comprises a plurality of air nozzles, a row of joint nozzles and a U-shaped circumrotating plate. The air nozzles are provided along the upstream and midstream of the surface on the lower side of the fabric guiding tube. The joint nozzles are provided on the two sides of the pathway and these nozzles are configured in a linear manner. The U-shaped circumrotating plate is disposed and fixed in the downstream portion of the joint nozzles. A reflective motion plate, which is a flat plate, is formed on the upstream portion of the U-shaped circumrotating plate. An outer separating net barrier is provided in the upstream fabric flop portion. Therefore, in use, the air and operating solution in the processing tank and the dyes and processing fluid in the reserve tank may enter the blower and circulation pump through the pipelines so that the air, fluid and dyes may be compressed and sprayed out of the joint nozzles and a part of the compressed air may be sprayed out from the air nozzles. In use, the compressed air sprayed out from the air nozzles may enable the fibrous fabric to float in the tank. Most of the compressed air is sprayed out from the joint nozzles. The direction of the air coming out from the joint nozzles is changed by the U-shaped circumrotating plate and then the air flow acts on the fibrous fabric. Therefore, in use, most of the kinetic energy of the fibrous fabric is provided by the joint nozzles. Whence, in the dyeing machine of the present invention, the fabric circulation wheel of the prior art is not needed and the spraying nozzles of the prior art may be removed because the kinetic energy is overly spread out and hence processes requiring higher energy can not be carried out. In addition, the effect of plasma (generated by the device of corona discharge or glow discharge) may be used with the mist converting device to achieve the goals of waterless processes and innovative process.

An object of the present invention is to provide an impulse type shock wave flash dyeing machine in which, in use, high-speed wet or dry hot air injected out of the joint nozzles, fast-moving and evenly spread out dyes, fast-moving and evenly spread out processing fluids, fast-moving low-temperature plasma and other types of mist may be imparted with sufficient amount of kinetic energy (activation energy) and repeatedly collide with the fibrous fabric in a high energy wave field. Therefore, kinetic energy may be transferred from the air, dyes, processing fluids, etc. to the fabric in a very short period of time. Whence, dyeing and other processes may be done in a manner that is the most efficient in terms of energy consumption, water consumption, dye consumption and processing agent consumption.

Another object of the present invention is to provide an impulse type shock wave flash dyeing machine in which a mixture, which consists of dyes and processing agents, is formed in the tank and such mixture has a low level of viscosity and resistance and a high level of potential energy, diffusion and expandability via the violent high-frequency wavy motion or the effect of shock wave, which is caused by the wavy motion, so as to be used to carry out wet type process on the fibrous fabric in the manner that only a small amount of fluid is needed and has a high level of concentration and efficiency. With respect to the effect of shock wave, shock wave is a high-energy wave motion generated by the high-speed air flow. A compressed area is formed in the peak area and a decompressed area is formed in the trough area. In the compressed area, air is compressed (because the distances between air molecules become smaller) and the density of air is increased. In the decompressed area, air is decompressed (because the distances between air molecules become larger) and the density of air is decreased. If the fabric moves fast enough in the form of wave motion, the molecules of the operating fluid are affected by the effects of compression and decompression. When the negative pressure of decompression is lower than the critical pressure of the saturated vapor pressure, the average distance between the molecules of the operating fluid would exceed the critical distance, destroying the attraction between the fabric and these molecules and creating cavities in the surfaces of the fabric or in the space inside or outside the fabric. Once such cavities occur, they keep on growing until their negative pressure reaches a maximal value. Therefore, a large amount of cavities (i.e., steam bubbles or air bubbles with a very low density) would be brought into existence. When the compressed areas reach these cavities, these cavities would be squeezed and burst. Therefore, the effect of shock wave takes place. Whence, the shock wave is created by the burst of the cavities and is generated by the cavities and the energy contained in the compressed areas. As the cavities burst, a shock wave pointing at the center of the bubble would occur. When such shock wave reaches the fibrous fabric, temperature and pressure would rise substantially in a small area or in the non-crystalline areas in a very short period of time. Therefore, in use, the shock waves generated by the burst of cavities can accelerate the entry and diffusion of the dyes and processing agents into the fibrous fabric and impart kinetic energy to the molecules of the fibrous fabric (to become activated molecules) and generate the effect of plasticization to these molecules and enhance the solubility of the molecules. Therefore, the goal of swift dyeing process and other processes may be reached.

A third object of the present invention is to provide an impulse type shock wave flash dyeing machine in which, the effect of shock wave, which is generated in the high-energy wave field, may be used to change the innate quality of the fibrous fabric during the dyeing process or other processes.

On the molecular level, either natural fiber or synthetic fiber consists of molecules that are in the form of long chain and are made of the atoms of carbon (as the skeleton), hydrogen, oxygen (as the ornament) and nitrogen (as the ornament). Either type of fiber comprises crystalline areas and non-crystalline areas. In a crystalline area, molecules are arranged in an orderly fashion and the bonding forces between the molecules are stronger; also, it would be difficult for the molecules of a dye to enter a crystalline area. On the other hand, in a non-crystalline area, molecules are arranged in a disorderly fashion and the bonding forces between the molecules are weaker. In dyeing or other process, the molecules of dyes or processing agents can only enter such non-crystalline area; however, these molecules can not enter such non-crystalline area in a dry condition or under the room temperature.

According to the dyeing theories, to enable dyeing to be carried out smoothly, the aim is to enlarge the gaps in the non-crystalline areas or to enlarge the surface ratio (between the interior and the exterior of the fabric). Also, the gaps are the origin of the damage of the fabric according to the theories of material mechanics. When the fibrous fabric undergoes violent wave motion and is affected by the burst of cavities, the crystalline structure of the fabric may be changed into a disorderly configuration and some molecules of the fabric may be broken or rearranged. Also, the surface ratio would increase and the gaps in the non-crystalline areas would be enlarged. Whence, the innate quality of the fibrous fabric may be changed and such change may be carried out during the dyeing process.

A fourth object of the present invention is to provide an impulse type shock wave flash dyeing machine in which fast-moving low-temperature plasma is used to carry out waterless removal of processing fluids or to remove impurities or to change the innate quality of the fibrous fabric before dyeing. Plasma is generated by the tip of an electric discharge rod portion, which is centrally disposed in the central pathway of the mist nozzle, under an atmospheric pressure (fast-moving air or other gas is used as the medium). The electric discharge rod portion is connected with a high voltage source. During discharge, electrons are released from the tip and move toward a circular target. As the electrons move toward the target, they collide with the fast-moving air flow. Because these electrons have a high level of kinetic energy, such collision can ionize the air molecules. Therefore, during a waterless process, electrons, ions, free radicals and energized atoms and molecules may be released from the joint nozzles and then violently collide with the surfaces of the fibrous fabric. In the collision process, free radicals are generated and the surfaces of the fibrous fabric would be oxidized. Also, natural impurities of the fibrous fabric, processing fluids and grease may be removed to enhance the fabric's capacity in water absorption and diffusion. In the pre-treatment of the prior art, a big amount of chemical fluid and a lot of water are used; therefore, such pre-treatment has a low level of efficiency, consumes more energy and generates more waste water. Therefore, the use of low-temperature plasma can remove impurities and such use may the wet type pre-treatment. Also, such application can shorten the time of processes, reduce the amount of chemical agents and lower the necessary temperature in the processes. Therefore, such application can increase the efficiency in production, lessen the consumption of water and the amount of contaminated water generated in the processes and reduce the carbon footprint. Whence, the use of fast-moving low-temperature plasma is economical and environmentally friendly.

A fifth object of the present invention is to provide an impulse type shock wave flash dyeing machine, which has multiple functions and may be used to carry out dyeing, quality changing processes, removal of processing fluids, refining processes, whitening process, biological enzyme treatment, loose part treatment, discolored part treatment, disheveled part treatment, softening treatment, expansion and contraction treatment, wrinkle treatment, color modification treatment, etc. on various types of fibrous fabric. Therefore, the goals of processes that are swift, easy to carry out, effective and safe and the goals of the saving of dyes, processing fluids, energy and water may be reached. Furthermore, processes may be carried out in a clean manner (to lower the pollution to the environment) and the goal of automation may be achieved.

A sixth object of the present invention is to provide an impulse type shock wave flash dyeing machine in which a row of joint nozzles supply all the kinetic energy needed by the fabric to move around in the processing tank (as so to remove the use of the fabric circulation wheel in the prior art) and the fast-moving air flow sent from these joint nozzles can enable the fabric to fold up automatically (as so to remove the use of the fabric flop wheel in the prior art). Therefore, the fabric would not be damaged by the circulation wheel and fabric flop wheel and the discontinuity in revolution of these wheels of the prior art may be eliminated. Consequently, the goals of easy control and stable motion may be achieved.

A seventh object of the present invention is to provide an impulse type shock wave flash dyeing machine in which, in use, the wiggling of the fibrous fabric can make the operating solution remaining on the surface of the fibrous fabric, loose fibers, unneeded dyes and solid objects detach from the fibrous fabric thanks to the direction-changing air flows. Therefore, only a minimal amount of the residual operating fluid remains on the fabric and the process may be carried out with a minimal amount of the operating fluid. Whence, the goals of minimal amount of operating solutions and a high level of concentration may be achieved.

An eighth object of the present invention is to provide an impulse type shock wave flash dyeing machine in which fast-moving low-temperature plasma is used to carry out removal of processing fluids, refining, quality changing of the surfaces of the fabric and combination. Therefore, the goals of waterless processes and an additional innovative approach may be achieved.

A ninth object of the present invention is to provide an impulse type shock wave flash dyeing machine in which dyes and processing agents may be added into the content adding tank before the start of the dyeing process or other processes. In this way, electric consumption may be reduced.

A tenth object of the present invention is to provide an impulse type shock wave flash dyeing machine in which the circulation wheel of the prior art is not needed at the front entry of the fabric guiding tube and the fabric flop wheel of the prior art is not needed at the outlet of the fabric guiding tube. Therefore, safety may be enhanced and a user would not be affected by the presence of the circulation wheel. In addition, the fabric would not be damaged by the fabric circulation wheel and the jamming. Also, the speed at which the fabric moves would not be limited by the fabric flop wheel as the fabric passes the fabric guiding tube.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
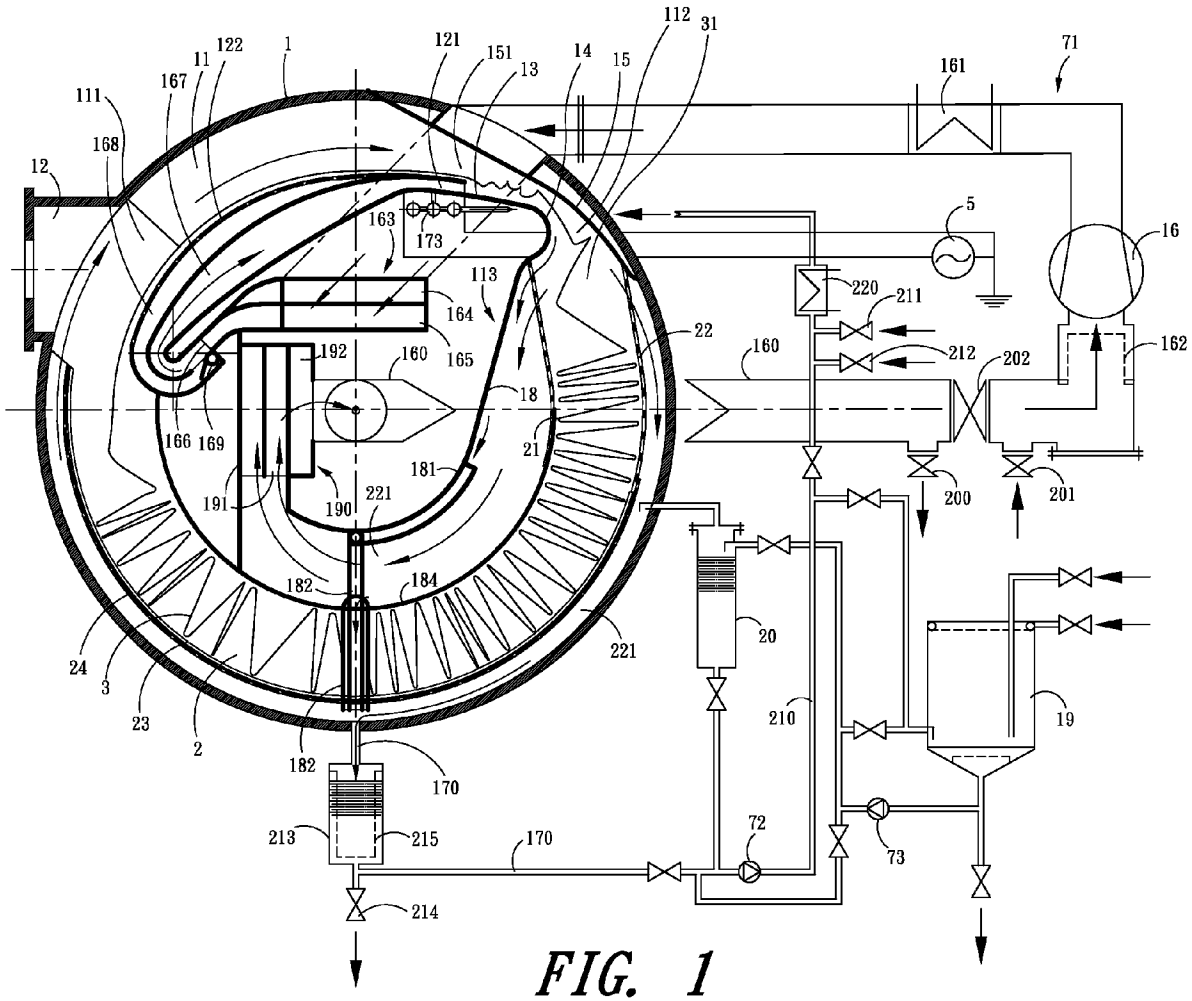
FIG. 1 is a sectional view showing the impulse type shock wave flash dyeing machine of the present invention.

Please see FIGS. 1 to 7, which illustrate the impulse type shock wave flash dyeing machine of the present invention. The dyeing machine of the present invention includes the following parts and components: a processing tank 1, fabric accumulator 2, fibrous fabric 3, fabric guiding tube 11, doorway 12, reflective motion plate 13, U-shaped circumrotating plate 14, direction guiding plate 15, blower 16, fluid gathering plate 18, reserve tank 19, pump-less content adding device 20, inner separating net barrier 21, outer separating net barrier 22, slider 23, net-holed plate 24, upstream fabric flop portion 31, a row of slits 42, entry 43, backflow entrance 46, arc-shaped distributing tube portion 61, tube 62, air transporting pipeline 71, circulation pump 72, content adding pump 73, upstream inlet 111, downstream outlet 112, a row of joint nozzles 121, air nozzles 122, narrow passage 151, air backflow tube 160, air heat exchanger 161, air filtering unit 162, air cross flow distributor 163, right manifold 164, left manifold 165, converging outlet 166, distribution tube 167, distributing tube 168, air flow regulating valve 169, dye solution backflow tube 170, a row of inlets 172, fluid cross flow distributor 173, right manifold 174, left manifold 175, equal pressure distributing tube 176, a row of fluid distributing slits 178, fluid injecting entry 179, fluid gathering channel 181, liquid fluid guiding tube 182, operating solution gathering plate 184, air backflow unit 190, diverging tubes 191, T-shaped backflow tube 192, exhaust outlet and control valve 200, flesh air inlet and control valve 201, flow regulating valve 202, pressurized circulation fluid transporting tube 210, steam input and control valve 211, gas inlet and control valve 212, operating solution recovery and outlet 214, broad air flow circulative pathway 221, Circular target 12111, jet injecting tube 12121, replaceable electric discharge rod portion 12122, high voltage connector 12123, grounding terminal 12124, mist converting nozzle 1216, mist nozzle 12161, sliding rod portion 12164, seat portion 12165, spring piston 12167 and operating solution inlet 12169.

Figure 2:
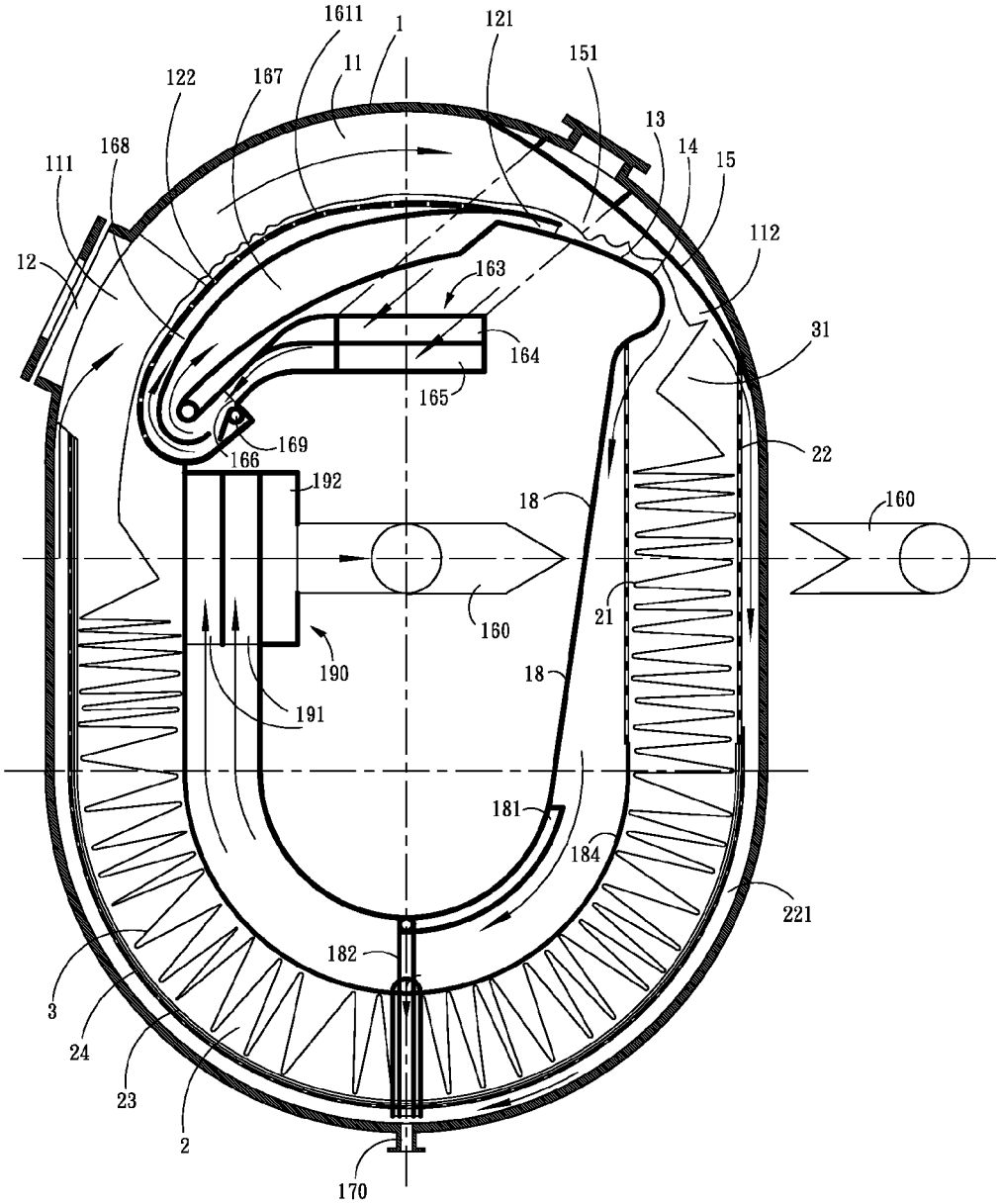
FIG. 2 is a sectional view showing the dyeing machine of the present invention with an additional height.
Figure 3:
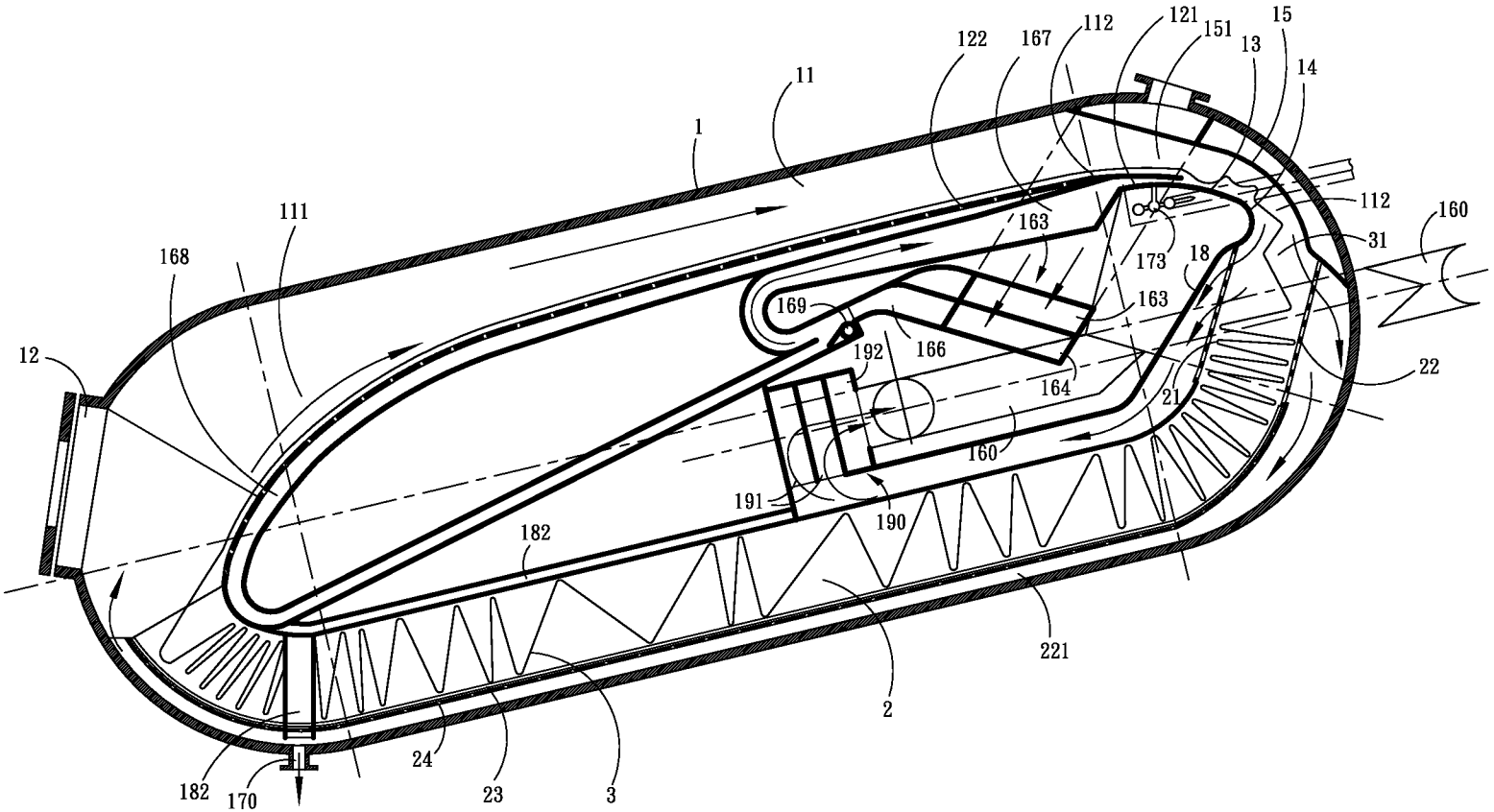
FIG. 3 is a sectional view showing the dyeing machine of the present invention with an additional length.

Please see FIGS. 1 to 3, which illustrate the structure of the processing tank 1. The processing tank 1 may be a single tank or several tanks arranged in a parallel configuration. The processing tank 1 is usually a sphere when it is used for processes under high temperature and high pressure. The processing tank 1 may have a different shape when it is used for processes under room temperature and one atmospheric pressure. In FIG. 2, the processing tank 1 has an extra height so that it can process more fabric. In FIG. 3, the processing tank 1 has an extra length so as to be used to process the fibrous fabric 3 that wrinkles easily and so that the fibrous fabric 3 can move around easily. In FIG. 1, the processing tank 1 is suitable to be used for either high or low temperature and for either high or low pressure and has an oval shape. The fabric accumulator 2 and the fabric guiding tube 11 may be formed along the wall in the processing tank 1 and form a circular circulative pathway. The fabric guiding tube 11 is disposed directly above the fabric accumulator 2. For the sake of description, we suppose the fibrous fabric 3 moves in the clockwise direction; the 9 o'clock direction is defined as the front portion of the processing tank 1 and the 3 o'clock direction is defined as the rear portion of the processing tank 1. A dye solution backflow tube 170 is disposed in the lowest portion (in the 6 o'clock direction) of the processing tank 1. An air backflow tube 160 is centrally disposed in the processing tank 1. A doorway 12 is provided by the front portion of the processing tank 1.

The upstream inlet 111 of the fabric guiding tube 11 is provided near the front portion of the processing tank 1 and abuts on the doorway 12. The upstream inlet 111 is in fluid communication with the downstream outlet 112. The downstream outlet 112 is located in the rear portion of the processing tank 1 and is in fluid communication with the upstream inlet 111. Therefore, the fabric guiding tube 11 is in fluid communication with the fabric accumulator 2 to form a broad circulative pathway, which allows the fibrous fabric 3 to move along the pathway in a spread-out manner in a dyeing process or other processes. A plurality of air nozzles 122 are provided along the upstream and midstream of the surface on the lower side of the fabric guiding tube 11. A row of joint nozzles 121 is provided on the two sides of the pathway and these nozzles are interconnected in parallel. Please see FIGS. 4A and 4B for the structure of the joint nozzles 121. A mist converting nozzle 1216 is disposed at the upstream portion of the acceleration injecting tube of the joint nozzles 121 and consists of a seat portion 12165 and a sliding rod portion 12164. The amount of the spray is determined by the cross-sectional area between the seat portion 12165 and the sliding rod portion 12164 and the fluid pressure. A spring piston 12167 is disposed on the sliding rod portion 12164. When the mist converting nozzle 1216 is clogged by fabric or a solid object, compressed air or fluid may enter into the chamber of the spring piston 12167 through an operating solution inlet 12169. When the pressure of the chamber is greater than the force of the spring, the sliding rod portion 12164 moves rearwards. Now, the cross-sectional area increases and hence the fabric or solid object may be removed. In use, if we want to increase the amount of the mist or spray, we can increase the pressure of the chamber.

Figure 4A:
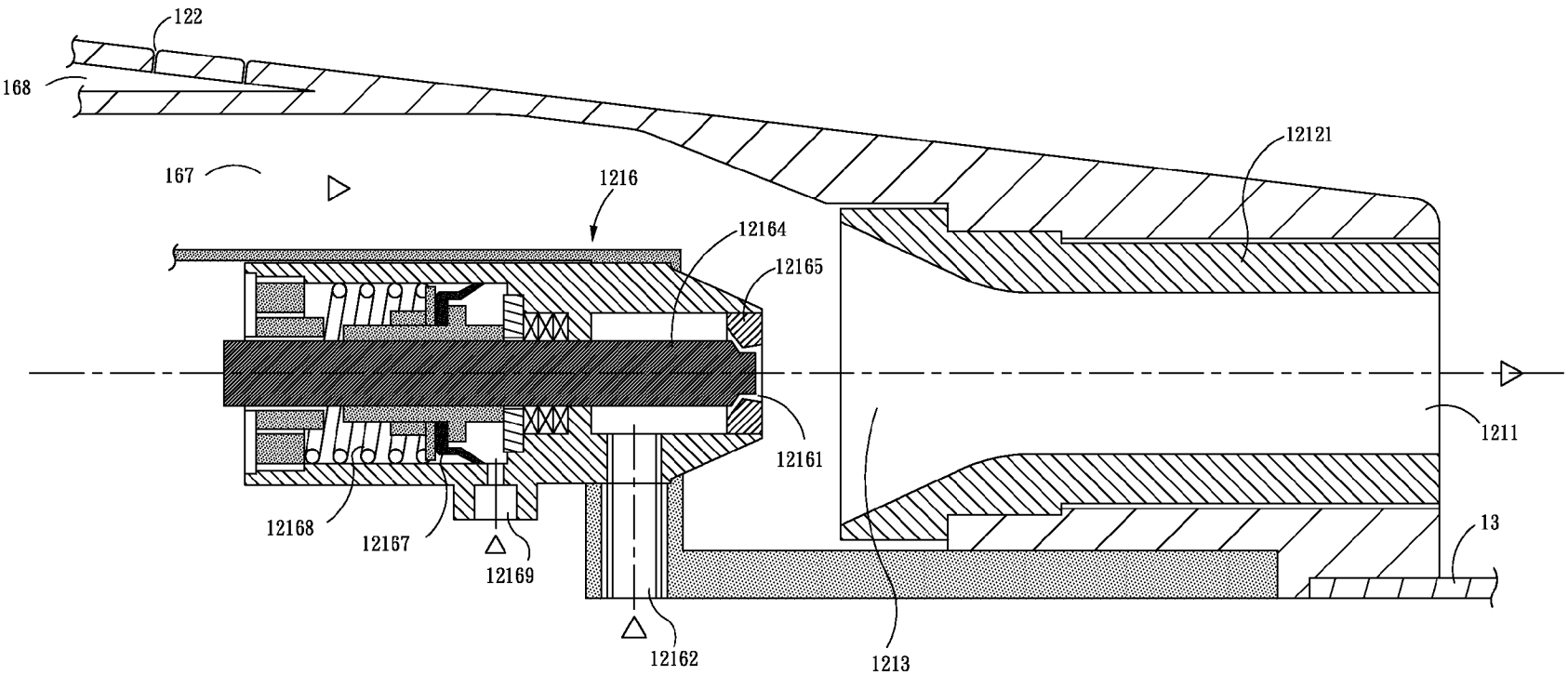
FIG. 4A is a sectional view of the joint nozzles.
Figure 4B:
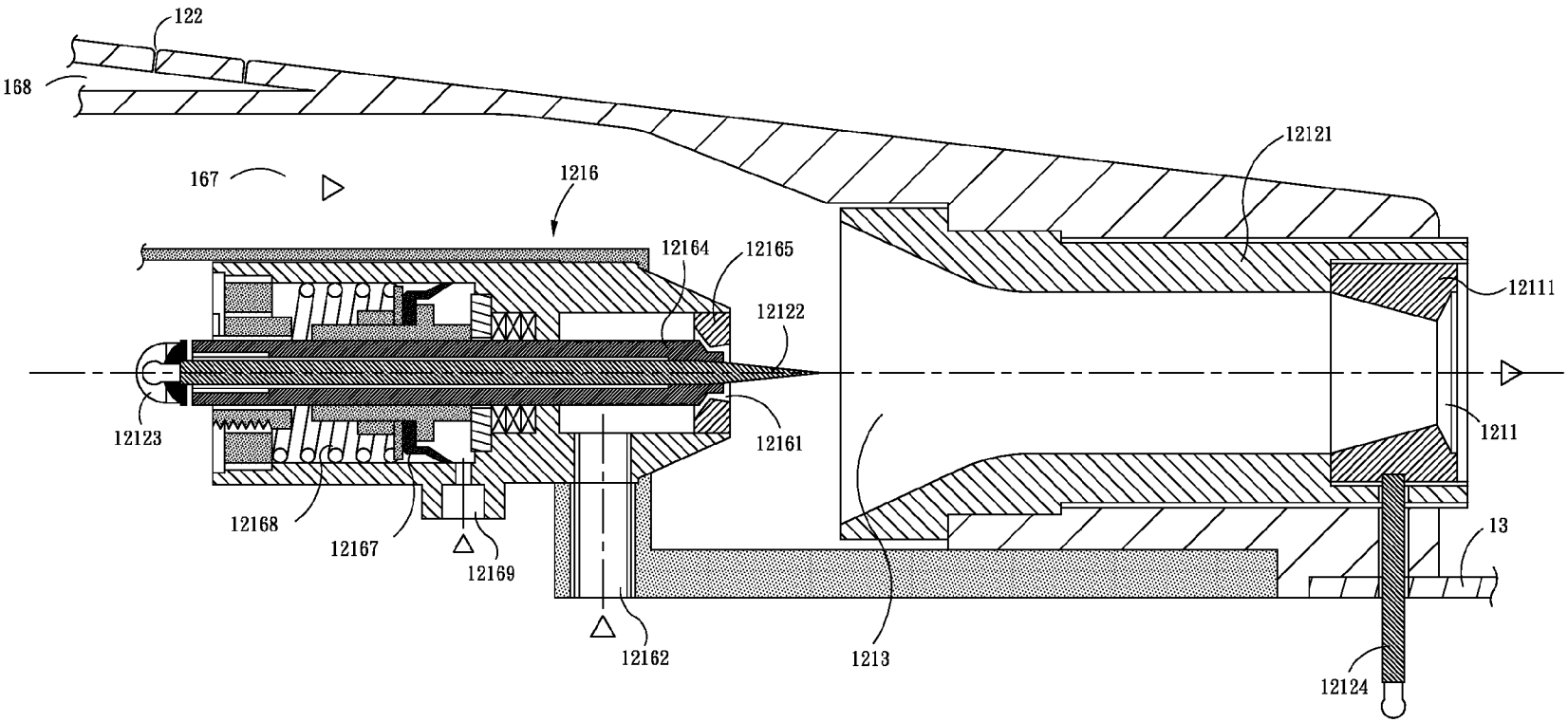
FIG. 4B is a sectional view of the joint nozzles with a replaceable electric discharge rod portion.
Figure 5:
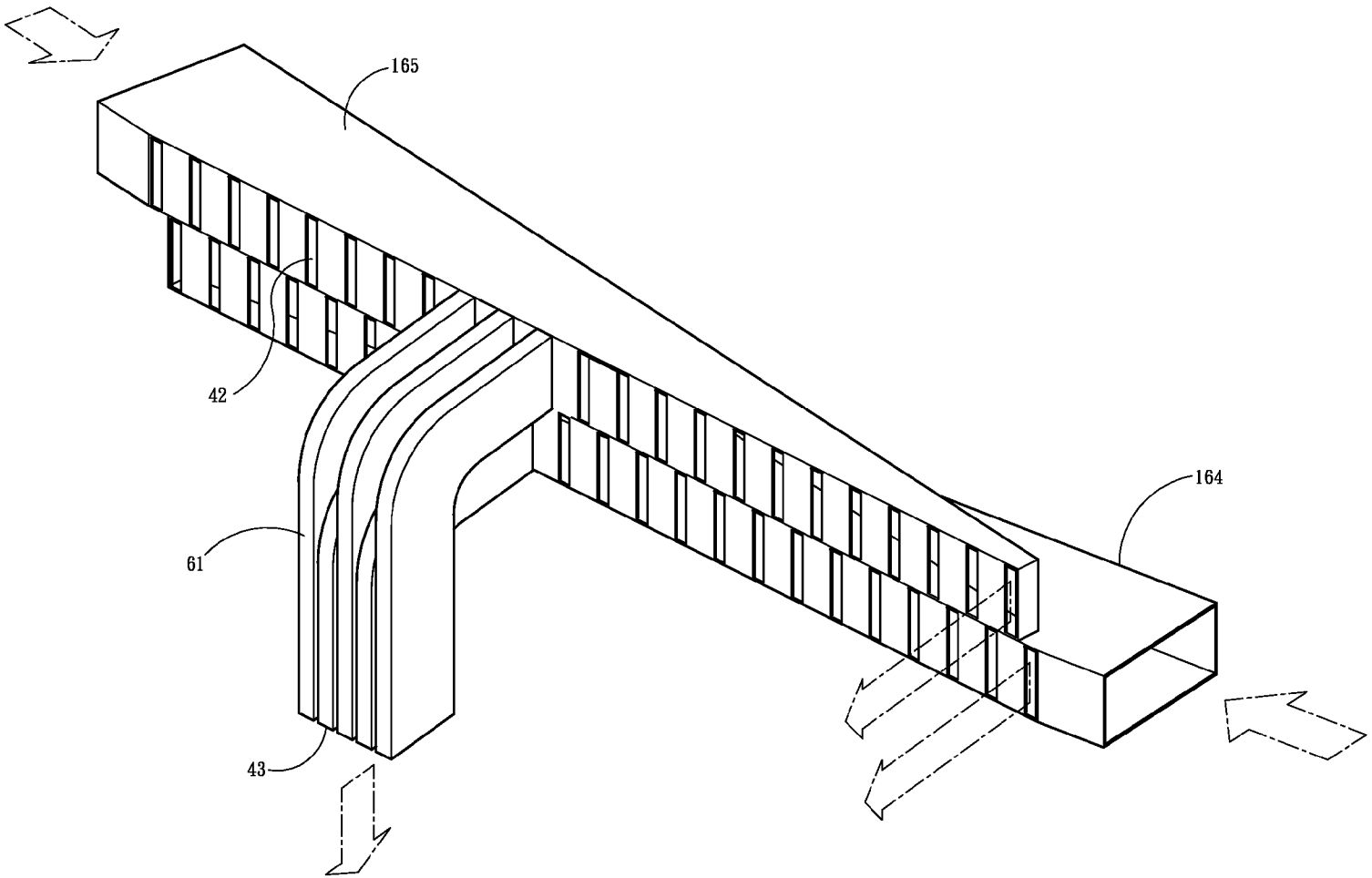
FIG. 5 is a perspective view of the air cross flow distributor.
Figure 5A:
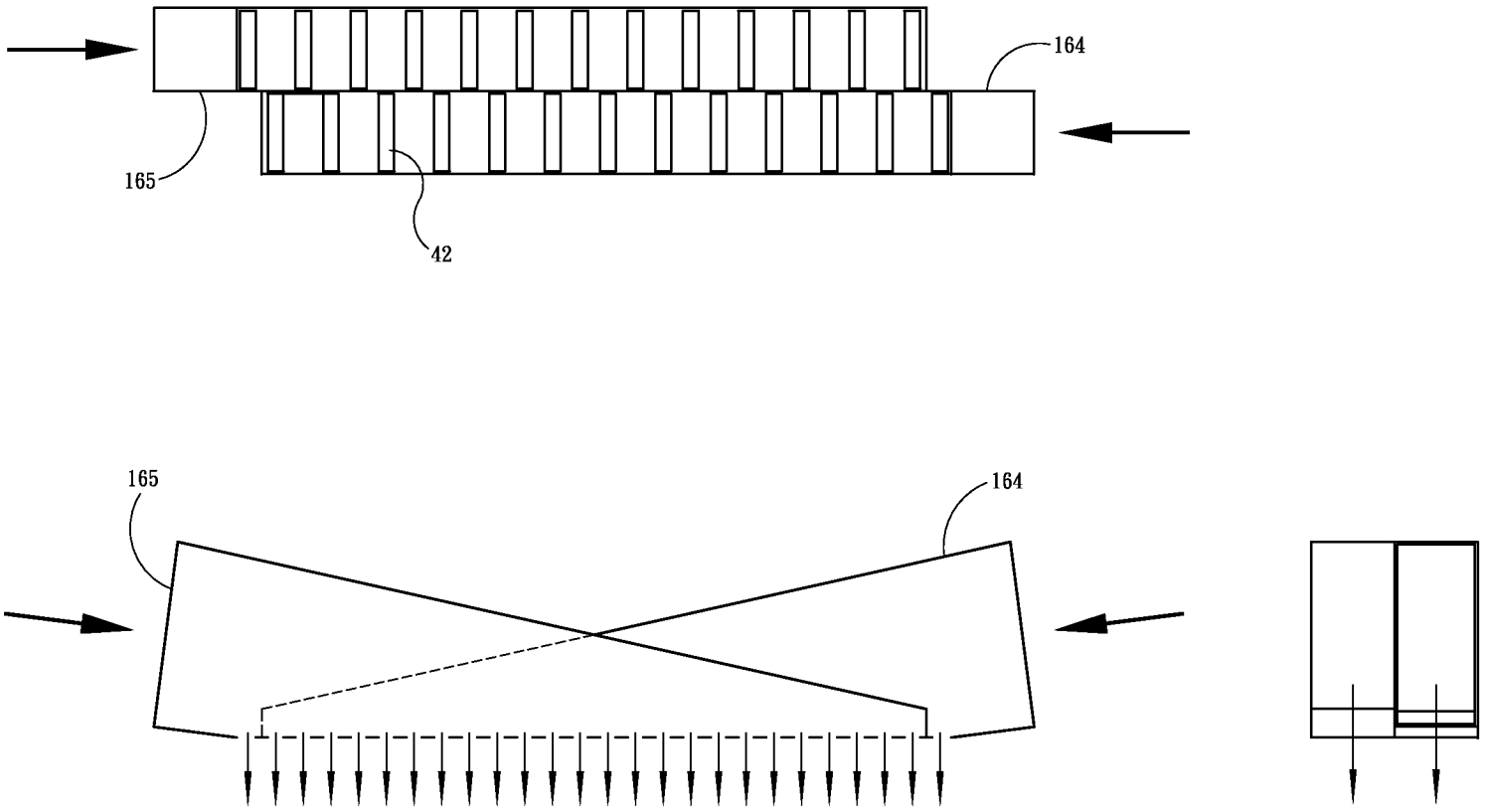
FIG. 5A is a sectional view of the air cross flow distributor.
Figure 5B:
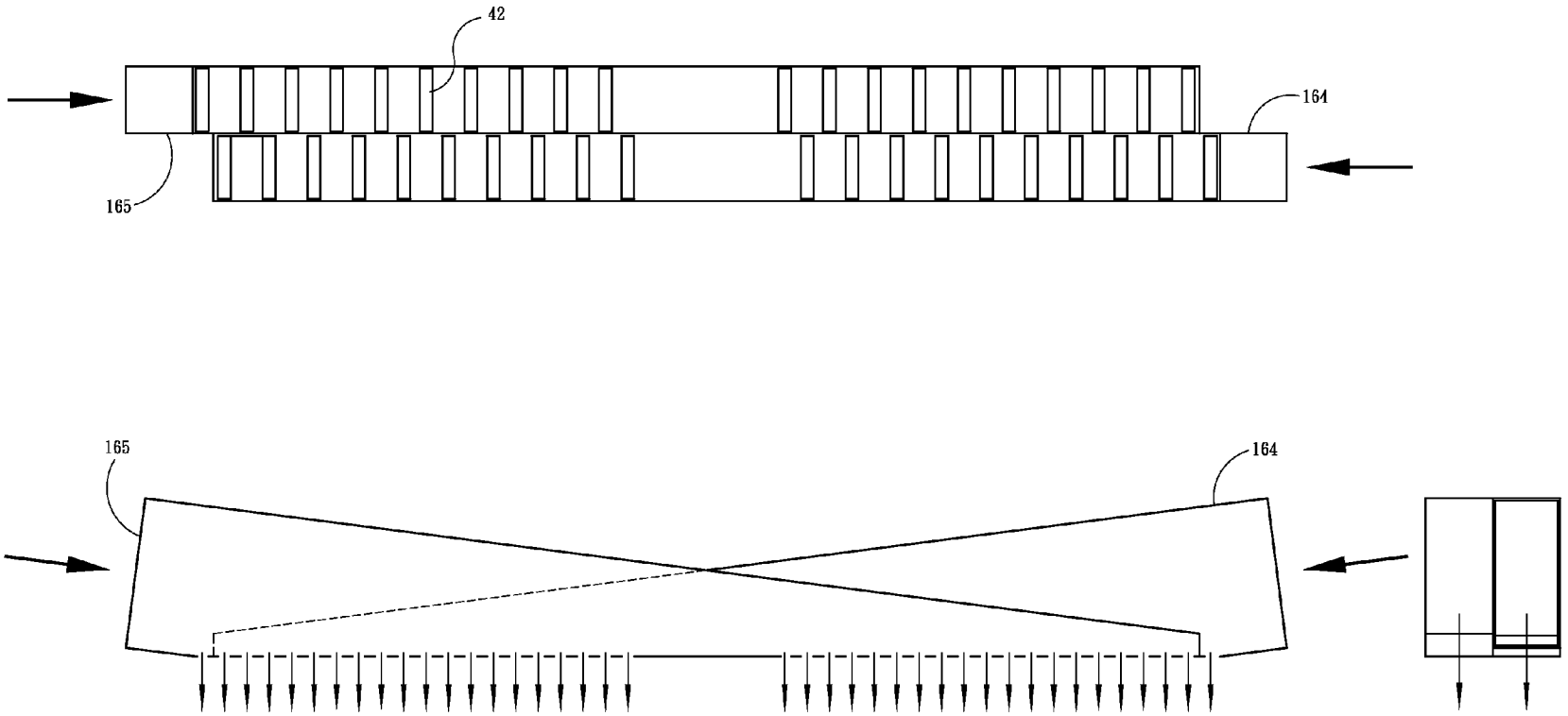
FIG. 5B is a sectional view of the air cross flow distributor that comprises a left manifold and a right manifold.

Please see FIGS. 1 and 4A. The mist converting nozzle 1216 is connected with the pipelines 210 and 170 at the circulation pump 72 via a fluid cross flow distributor 173. Therefore, dye or processing agent may be pressurized by the circulation pump 72 and then may be converted into fine mist by a mist nozzle 12161. Pressure equal or more than 5 Kg/square cm can convert the dye or processing agent into fine mist. The level of such conversion would be enhanced if the pressure or temperature increases. To impart greater kinetic energy to the dye or processing agent, the angle of the spray is controlled within a range to make the dye or processing agent thoroughly spread out in a jet injecting tube 12121 and then the mist may be mixed with the high speed air flow so that the mist may become fine mist as the dye or processing agent passes the joint nozzles 121. Therefore, the dye or processing agent can have enough amount of kinetic energy when blasting the fibrous fabric 3. As illustrated in FIG. 4B, to reach the goal of clean processes, a replaceable electric discharge rod portion 12122 may be centrally disposed in the central pathway of the mist nozzle 12161. A high voltage connector 12123 is provided at one end of the electric discharge rod portion 12122 and may be connected with a high voltage source 5 outside the processing tank 1 via a wire. The wall of the jet injecting tube 12121 is made of an insulating material. Therefore, a circular target is formed at the joint nozzle outlet 1211. A grounding terminal 12124 is provided on the circular target. Therefore, the circular target may be grounded via a wire.

A distributing tube 168 is provided at the lower portion of the fabric guiding tube 11 and along the upstream and midstream portions of the pathway. An air flow regulating valve 169 is provided at the upstream entry of the distributing tube 168. A distribution tube 167 is provided at the entry of the joint nozzle 121. An air cross flow distributor 163 is provided at the entry of the distribution tube 167 and in the path linking the distribution tube 167 and the air transporting pipeline 71. As illustrated in FIGS. 1, 5, 5A and 5B, the air cross flow distributor 163 comprises a left manifold 165 and a right manifold 164. The width of the left manifold 165 or the right manifold 164 is equal to the width of the fabric guiding tube 11. If the fabric guiding tube 11 is in the form of two tubes, the same applies. If the fabric guiding tube 11 is in the form of four tubes, the same applies. Also, the length of the left manifold 165 or the right manifold 164 may be increased or decreased according to the form of the fabric guiding tube 11. A row of slits 42 are provided on a wall of either manifold 165 or 164. An arc-shaped distributing tube portion 61 is provided on either manifold 165 or 164. The row of slits 42 provided on the left manifold 165 are not aligned with the row of slits 42 provided on the right manifold 164. The air flow may flow through the slits and then to the arc-shaped distributing tube portion 61 and the converging outlet 166. A tube 62 is connected to the downstream end of the converging outlet 166. The inlet at the upstream end of the tube 62 is in fluid communication with the converging outlet 166 and the outlet at the downstream end of the tube 62 is in fluid communication with the distribution tube 167 and the distributing tube 168.

Figure 6:
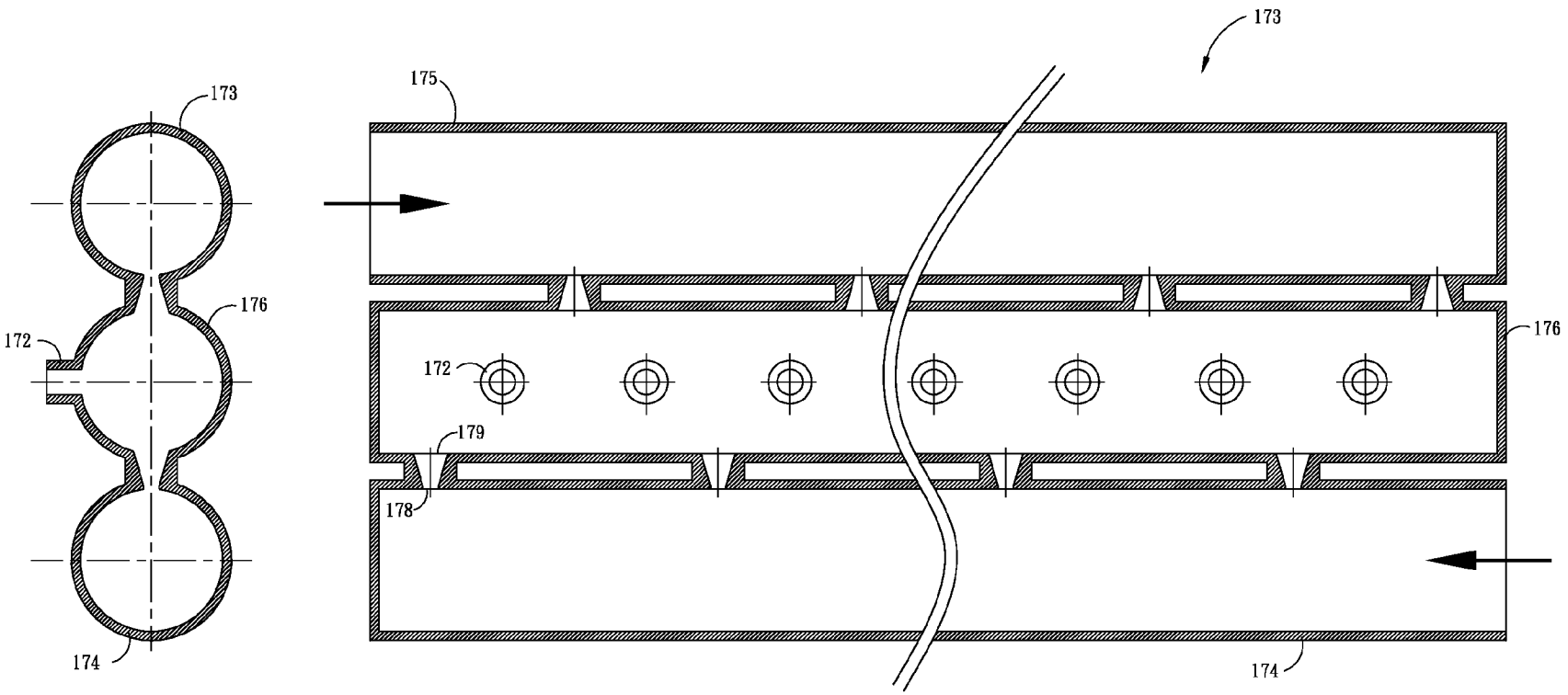
FIG. 6 is a sectional view of the fluid cross flow distributor.

Please see FIG. 6. The fluid cross flow distributor 173 is provided under the operating inlet 12162 and in the path linking with the compressed circulation fluid transporting tube 210. Please refer to FIGS. 1 and 6 for the structure of the fluid cross flow distributor 173. The fluid cross flow distributor 173 comprises a left manifold 175, a right manifold 174 and an equal pressure distributing tube 176. The width of the left manifold 175 or the right manifold 174 is equal to the width of the fabric guiding tube 11. If the fabric guiding tube 11 is in the form of two tubes, the same applies. If the fabric guiding tube 11 is in the form of four tubes, the same applies. Also, the length of the left manifold 175 or the right manifold 174 may be increased or decreased according to the form of the fabric guiding tube 11. A row of fluid distributing slits 178 are provided on the wall of either manifold 175 and 174. The slits provided on either manifold 175 and 174 are spaced apart and the slits provided on the left manifold 175 point at a direction different from the direction in which the slits provided on the left manifold 175 point or the slits provided on the left manifold 175 are not aligned with the slits provided on the left manifold 175, and wherein a row of inlets 172 are provided in the upper wall of the equal pressure distributing tube 176 to allow the fluid cross flow distributor 173 to be connected with the mist converting nozzle 1216 via tubes.

Figure 7:
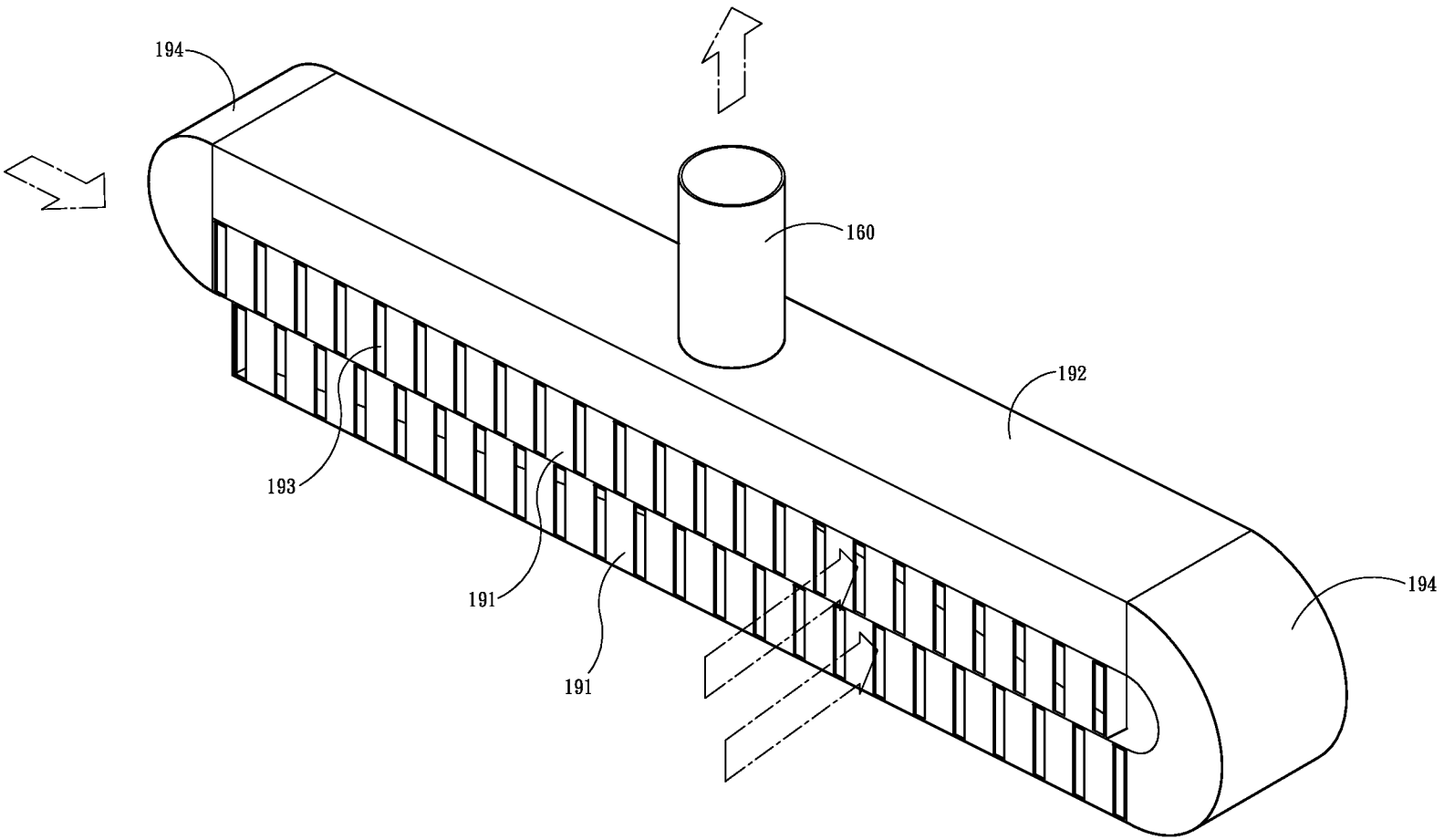
FIG. 7 is a perspective view of the air backflow unit.
Figure 7A:
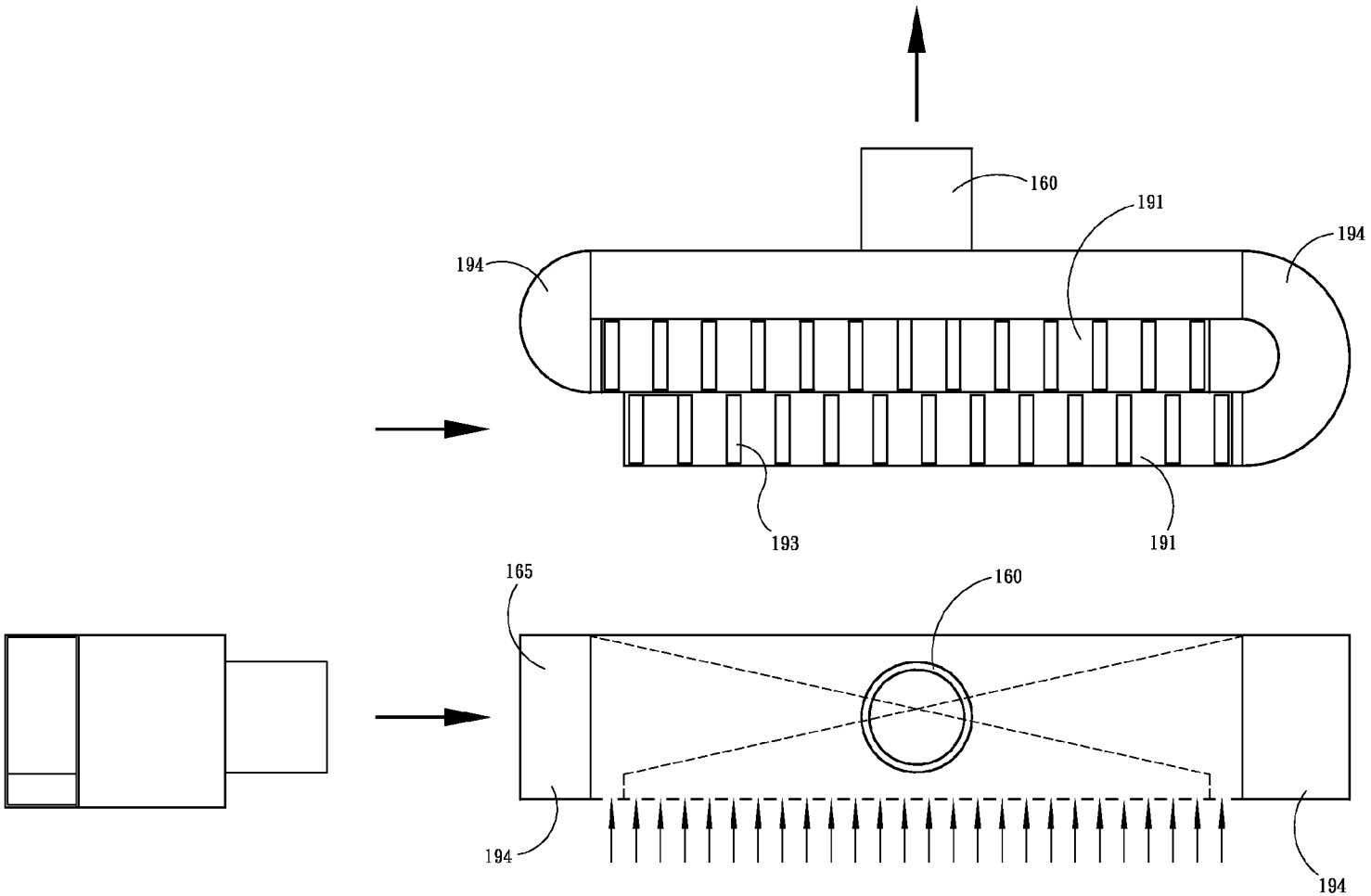
FIG. 7A is a sectional view of the air backflow unit.
Figure 7B:
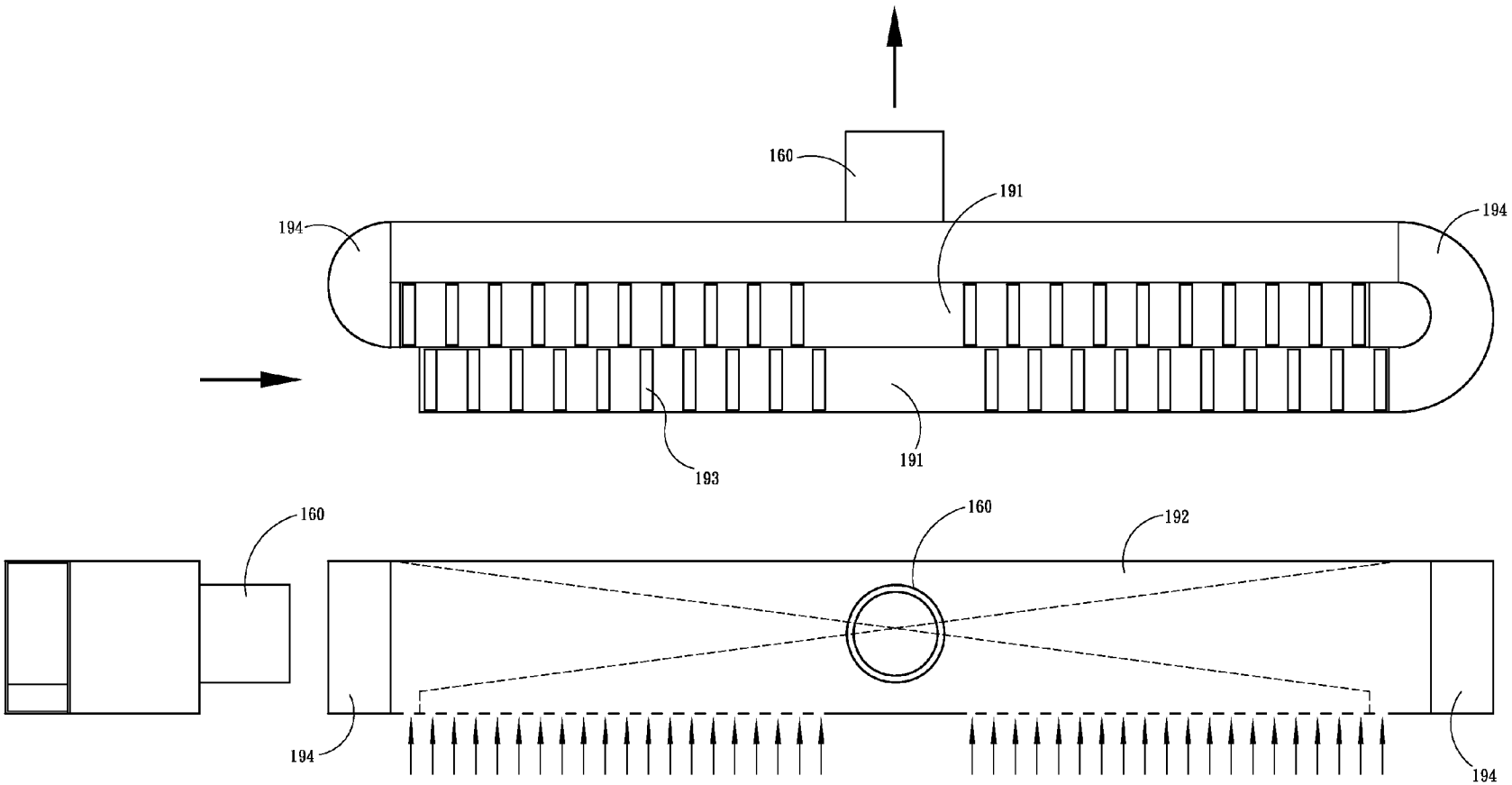
FIG. 7B is a sectional view of the air backflow unit that includes two tubes.

Please see FIGS. 1, 2 and 3. An air backflow unit 190 is provided in the central portion of the processing tank 1 and above the operating solution gathering plate 184. Please refer to FIGS. 7, 7A and 7B for the structure of the air backflow unit 190. Its structure is quite similar to that of the air cross flow distributor 163. The air backflow unit 190 comprises two diverging tubes 191 and a T-shaped backflow tube 192. The width of the two tubes 191 is equal to the width of the fabric guiding tube 11. If the fabric guiding tube 11 is in the form of two tubes, the same applies. If the fabric guiding tube 11 is in the form of four tubes, the same applies. Also, such width may be increased or decreased according to the form of the fabric guiding tube 11. A row of backflow slits 193 are provided on the wall of the underside of either tube 191. Two connective tube portions 194 with the shape of a bending arc of 180 degree connect the two tubes with the T-shaped backflow tube 192. Therefore, air flow may flow through the air backflow unit 190 and a backflow tube 160, which is provided in the middle portion of the T-shaped backflow tube 192, and then back to the blower 16.

In use, the fluid cross flow distributor 173 can make the same amount of flow coming out of each of the mist converting nozzles 1216. Also, the fluid cross flow distributor 173 can make the amount of flow coming out of each of the joint nozzles 121 equating the amount of flow coming out of each of the air nozzles 122. In use, the joint nozzles 121 impart most of the kinetic energy to the fabric 3 so that the fabric 3 may move around cyclically. The revolving speed of the propeller of the blower 16 may be increased or decreased according to the actual processing needs to achieve the proper amount of air flow. In addition, an air flow regulating valve 169 provided at the entry portion of the distributing tube 168 may be adjusted according to the weight per unit area of the fabric 3 so that proper amount air flow may come out from the air nozzles 122 to make the fabric 3 afloat and moving in a stable manner so that no contact and no friction would occur between the fabric 3 and the wall of the processing tank 1 to minimize the friction as the fabric 3 moves quickly in the processing tank 1. The joint nozzles 121 can make high-speed air flow, high-speed mist of dyes or processing agents, high-speed low-temperature plasma, high-speed vapor flow or high-speed gas or fluid blasting the fabric 3. In addition, a reflective motion plate 13 can generate wavy motions on the fibrous fabric 3. Air flows are guided by the reflective motion plate 13 and make the lower portion of the fibrous fabric 3 moving in the downstream direction. The difference in pressure prompts the fibrous fabric 3 to accelerate and move in the wavy motion. As the fibrous fabric 3 moves along the upstream and midstream of the pathway, a vertical downward pull would repeatedly exert on the upper portion of the fibrous fabric 3. The repetitive pulls prompt the fibrous fabric 3 to expand as it passes the downstream of the joint nozzles 121 and it moves in a spread-out, floating manner along the lower wall of the pathway as it quickly passes the upstream and midstream portions of the fabric guiding tube 11.

Please see FIGS. 1, 2 and 3. A U-shaped circumrotating plate 14 is provided between the lower side of the fabric guiding tube 11 and the entry portion of an upstream fabric flop portion 31 of the fabric accumulator 2. The upstream portion of the U-shaped circumrotating plate 14 is fixed to the lower side of the joint nozzles so that the reflective motion plate 13 may be formed near the upstream portion of the U-shaped circumrotating plate 14. An inner separating net barrier 21 and an outer separating net barrier 22 are provided in the upstream fabric flop portion 31. A direction guiding plate 15 is provided in the downstream portion of the fabric guiding tube 11 and directly over the joint nozzles 121. The upstream end of the direction guiding plate 15 is connected with the upper wall of the fabric guiding tube 11 and the downstream end of the direction guiding plate 15 is connected with the outer separating net barrier 22. With the presence of the direction guiding plate 15, a narrow passage 151 may be formed at the downstream portion of the fabric guiding tube 11. As the fibrous fabric 3 passes the narrow passage 151, air is squeezed and a downward pull would exert on the fibrous fabric 3. The high-speed air flow coming out of the joint nozzles may blast the fibrous fabric 3 and provides a continuous static pressure on the side of the fibrous fabric 3. Therefore, more energy may be transferred to the fibrous fabric 3 to strengthen the wavy motion of the fibrous fabric 3.

A solution removing mechanism is provided in the downstream exit portion of the fabric guiding tube 11 and in the upstream fabric flop portion 31. The fluid solution removing mechanism consists of the U-shaped circumrotating plate 14, the direction guiding plate 15, the inner separating net barrier 21, the outer separating net barrier 22, a fluid gathering plate 18 and an operating solution gathering plate 184. The inner separating net barrier 21 and the outer separating net barrier 22 are disposed in the upstream fabric flop portion 31. The inner separating net barrier 21 runs from the portion where the U-shaped circumrotating plate 14 is connected with the fluid gathering plate 18 and the inner separating net barrier 21 is disposed inside the upstream fabric flop portion 31 in a vertical or substantially vertical position. The downstream end of the inner separating net barrier 21 is connected with the upstream end of the operating solution gathering plate 184. A fluid gathering channel 181 is provided in the downstream end of the fluid gathering plate 18. A fluid guiding tube 182 is provided on the downstream wall of the fluid gathering plate 18 and the lowest portion of the operating solution gathering plate 184 and can guide the operating solution to the outlet located on the lower portion of the fabric accumulator 2. The upstream end of the outer separating net barrier 22 is connected with the downstream end of the direction guiding plate 15. The downstream end of the outer separating net barrier 22 is connected with a slider 23 and a net-holed plate 24 provided on the lower side of the fabric accumulator 2. Therefore, a broad air flow circulative pathway 221 is formed between the fabric accumulator 2 and the wall of the processing tank 1 to guide the air flow from the outer separating net barrier 22 to enter the fabric guiding tube 11. The solution, fibers and other solid objects gathered by the outer separating net barrier 22 may go through the wall of the processing tank 1 to enter the outlet 170 and the operating solution gathering tank 213. In use, the high-speed air flow sent out from the joint nozzles 121 would flow above the upper portion of the inner separating net barrier 21 due to the interaction between the underside of the fibrous fabric and the reflective motion plate 13 and the interaction between the underside of the fibrous fabric and the U-shaped circumrotating plate 14. In the mean time, the fibrous fabric 3 would be moved by the air flow toward the inner separating net barrier 21 and hence the air pathway toward the inner separating net barrier 21 would be blocked. Therefore, the fibrous fabric 3 would be moved toward the outer separating net barrier 22 and the lower portion of the upstream fabric flop portion 31. Therefore, the fibrous fabric 3 would move by the downward expanding air flow from the upper portion of the inner separating net barrier 21 toward the lower portion of the inner separating net barrier 21. As the fibrous fabric 3 leaves the upper portion of the inner separating net barrier 21, the air pathway re-opens and the air flow would flow toward the inner separating net barrier 21 and then flow out of the inner separating net barrier 21. Such process would keep on repeating itself, making the fibrous fabric 3 wiggling violently as the fibrous fabric 3 passes the U-shaped circumrotating plate 14. During the process, the operating solution attached to the surface of the fibrous fabric 3 would detach from the fibrous fabric 3 thanks to the direction-changing air flow. The operating solution would then flow through the inner separating net barrier 21 and the outer separating net barrier 22 and then leaves the upstream fabric flop portion 31. In the mean time, the fibrous fabric 3 entering the fabric accumulator 2 may be folded up thanks to the wiggling motion.

Please see FIGS. 1, 2 and 3. An air filtering unit 162, an exhaust outlet and control valve 200 and a flesh air inlet and control valve 201 are provided on the backflow tube 160. A flow regulating valve 202 is provided between the exhaust outlet and control valve 200 and the flesh air inlet and control valve 201. A steam input and control valve 211 and a gas inlet and control valve 212 are provided on the pressurized circulation fluid transporting tube 210. An operating solution gathering tank 213 and a recovery and outlet 214 are provided on the lowest portion of the processing tank 1. The aforesaid valves may be adjusted according to the actual need.

The dyeing machine of the present invention further comprises an air heat exchanger 161 and an air filtering unit 162. The air heat exchanger 161 is provided on the air transporting pipeline 71. The air filtering unit 162 is provided on the air backflow tube 160. Therefore, the air heat exchanger 161 and the air filtering unit 162 form a pathway with the blower 16.

Therefore, in the dyeing process or other processes, the air and operating solution in the processing tank 1 and the dyes and processing agents in the pump-less content adding device 20 and the reserve tank 19 may be in fluid communication with the blower 16 and the content adding pump 73 via several pipelines so that compressed air and compressed dyes and processing agents may be injected out of the joint nozzles and a part of the compressed air may be injected out of the air nozzles 122.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An impulse type shock wave flash dyeing machine, comprising:

one or more processing tanks (1), wherein the tanks are arranged in a parallel configuration and are connected with pipelines (71, 160, 210 and 170), and wherein a fabric accumulator (2) is provided in each processing tank (1) and may facilitate an accumulation of fabric, and a fabric guiding tube (11) is provided in each processing tank (1) and can accelerate a motion of the fabric, and wherein the fabric guiding tube (11) is in fluid communication with the fabric accumulator (2) to form a circulative pathway, characterized in that the fabric may be spread out when being processed so that a dyeing process and other processes may be carried out;

a plurality of air nozzles (122), wherein each air nozzle has an air outlet and the air nozzles (122) are provided along an upstream and midstream of a surface on a lower side of the fabric guiding tube (11), and wherein the air nozzles (122) are connected with a blower (16) via a distributing tube (168) and the pipelines (71 and 160);

a row of nozzles (121), wherein each nozzle (121) comprises a jet injecting tube (12121) and a mist converting nozzle (1216) and the nozzles (121) are provided on two sides of the pathway and these nozzles are interconnected in parallel, and wherein the nozzles (121) are connected with the blower (16) and a circulation pump (72) via a distribution tube (167) and air flow pipelines (71 and 160);

a U-shaped plate (14), disposed in a downstream portion of a flat plate (13), wherein the U-shaped plate (14) is an extension of the flat plate (13);

a fluid gathering plate (18), disposed at a downstream end of the U-shaped plate (14);

a fluid gathering channel (181), disposed at a downstream end of the fluid gathering plate (18);

a fluid guiding tube (182), disposed on a downstream wall of the fluid gathering channel (181);

an inner separating net barrier (21), wherein the inner separating net barrier (21) runs from a portion where the U-shaped plate (14) is connected with the fluid gathering plate (18) and the inner separating net barrier (21) is disposed inside an upstream fabric portion (31) in a vertical or substantially vertical position;

an outer separating net barrier (22), wherein the outer separating net barrier (22) runs from a lower end of a direction guiding plate (15) and a lower end of the outer separating net barrier (22) is connected with a slider (23) and a net-holed plate (24) provided on a lower side of the fabric accumulator (2); and an operating solution gathering plate (184), disposed at a lower end of the inner separating net barrier (21) and located in an upstream portion of the fabric accumulator (2).

2. The impulse type shock wave flash dyeing machine as in claim 1, wherein a mist converting nozzle (1216) is provided at an upstream end of an entry portion (1213) of each nozzle (121) and a replaceable electric discharge rod portion (12122) is centrally disposed in a central pathway of the mist nozzle (12161), characterized in that a high voltage connector is provided at one end of the electric discharge rod portion (12122) and may be connected with a high voltage source (5) outside the processing tank (1) via a wire, and wherein, therefore, a circular target (12111) is formed at a nozzle outlet (1211) and the circular target (12111) may be grounded via a wire.

3. The impulse type shock wave flash dyeing machine as in claim 1, wherein the flat plate (13), is disposed in a downstream portion of the nozzles (121) and is fixed at the downstream portion.

4. The impulse type shock wave flash dyeing machine as in claim 1, wherein the U-shaped plate (14), is provided in a downstream portion of the nozzles (121) and between the lower side of the fabric guiding tube (11) and an upstream entry portion of the fabric accumulator (2).

* * * * *